US007488223B1

(12) United States Patent
Miyazaki et al.

(10) Patent No.: US 7,488,223 B1
(45) Date of Patent: Feb. 10, 2009

(54) CABLE CONNECTING CONNECTOR

(75) Inventors: Makoto Miyazaki, Tokyo (JP); Chiharu Nunokawa, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 12/213,189

(22) Filed: Jun. 16, 2008

(30) Foreign Application Priority Data

Jul. 23, 2007 (JP) ..... 2007-190582

(51) Int. Cl.
*H01R 4/02* (2006.01)

(52) U.S. Cl. ..... 439/874

(58) Field of Classification Search ..... 439/874, 439/492, 499; 174/88 R
See application file for complete search history.

(56) References Cited

U.S. PATENT DOCUMENTS 5,954,549 A * 9/1999 Shinchi ..... 439/874
7,402,073 B2 * 7/2008 Yotsutani ..... 439/394

FOREIGN PATENT DOCUMENTS

JP 2004-087388 3/2004

* cited by examiner

*Primary Examiner*—Phuong K Dinh
(74) *Attorney, Agent, or Firm*—Wenderoth, Lind & Ponack, L.L.P.

(57) ABSTRACT

To provide a cable connecting connector having connection strength between a conductor and a contact by reducing the resistance at the time of collectively soldering cables with different diameters, it is configured of a horizontally elongated insulating housing, a plurality of contacts each having a base part to be secured to the insulating housing, and a connecting part having a same height in an up and down direction, and arranged in parallel to one another and perpendicular to a lengthwise direction of the insulating housing, and thermoplastic holding base parts each protruding from a flat surface of the insulating housing into between the contacts and facing the connecting parts thereof.

7 Claims, 7 Drawing Sheets

CABLE CONNECTING CONNECTOR

BACKGROUND OF THE INVENTION

1. Field of the Invention

The present invention relates to a cable connecting connector for use in a case where multiple connection wires are used in connecting electronic devices such as computers, and collectively connecting a plurality of cables with different diameters to contacts of the cable connecting connector.

2. Prior Art

There is a cable connecting connector known that has deformable projections which are formed at those portions of an insulating housing at which connection terminals of contacts are provided, and abut on the connection terminals as shown in FIGS. 9A and 9B, for example, to collectively connect plurality of cables with different diameters (see JP-A-2004-87388).

The cable connecting connector has projections 22*a*, 22*b* of a synthetic resin protruding upward from an insulating housing 21 forming the connector and having heights to abut on the bottoms of contacts 23. At the time of collectively connecting cables, the horizontal bottom of a heat chip 25, when moved downward, first presses a thick cable conductor 24*b* in cable conductors 24*a*, 24*b* with different diameters, then presses the thin cable conductor 24*a*, and heats the cable conductors 24*a*, 24*b*. As a result, the heat of the heat chip 25 is transferred to the projections 22*a*, 22*b* of a synthetic resin to melt those, so that the projections 22*a*, 22*b* are deformed while keeping the adhesion state between the contacts 23 and the projections 22*a*, 22*b*. Because the heat chip 25 is a constant heating type heater apparatus and has a parallel contact surface, the upper end positions of the cable conductors 24*a*, 24*b* are flush with each other (Prior Art 1).

There is a cable connecting connector as another prior art, as shown in FIG. 10, which has a recess 21*a* formed in an insulating housing 21 at a portion underlying contacts 23 to allow for downward bending of the contacts 23, so that displacement originated from conductors 24 are absorbed (Prior Art 2).

Since the heat of the heat chip 25 is transferred over a long serial distance through the conductor 24*a* or 24*b*, the contact 23 and the projection 22 in the Prior Art 1, however, it takes time to melt the projection 22. Further, the bottom of the heat chip 25 abuts on the upper end of the thick conductor 24*b* first, deforming the projection 22*b*, then moves downward to abut on the upper end of the thin conductor 24*a*. To ensure soldering between the thin conductor 24*a* and the contact 23, therefore, it is necessary to adjust the time so that soldering on the thick conductor 24*b* is not overheated. In addition, the Prior Art 1 suffers a high pressing resistance.

In the Prior Art 2, the bending of the contact 23 in the pressing direction may form a clearance "C" between the conductor 24 and the contact 23 as shown in FIG. 11, impairing the adhesion therebetween. A further cable connecting connector is known, though not illustrated, which has plural types of cutaway portions provided at a heat chip so that the cutaway portions contact, in line, the upper portions of conductors with different diameters. This heat chip is a dedicated type, and undesirably lacks a general-purpose property.

SUMMARY OF THE INVENTION

Accordingly, it is an object of the invention to overcome the conventional problems and provide a cable connecting connector having connection strength between a conductor and a contact improved by reducing the resistance at the time of collectively soldering cables with different diameters.

According to the invention, there is provided a cable connecting connector for collectively connecting conductors of a plurality of cables with different diameters by a heat unit of a heating apparatus for connection, the connector including a horizontally elongated insulating housing, a plurality of contacts each having a base part to be secured to the insulating housing, and a connecting part having a same height in an up and down direction, and arranged in parallel to one another and perpendicular to a lengthwise direction of the insulating housing, and thermoplastic holding base parts each protruding from a flat surface of the insulating housing into between the contacts and facing the connecting parts thereof, wherein the connecting part of each contact is moved laterally according to the diameter of the associated conductor which is inserted between the connecting part and the holding base part facing and apart from the connecting part from above, and the holding base part is melted by heat of the conductor heated to permit downward insertion thereof, thus ensuring collective connection of a plurality of conductors with different diameters.

To ensure smoother collective connection, it is preferable that the contact should have a crank part formed at a joint portion of the base part and the connecting part and bent laterally toward the holding base part, so that the contact is bendable in a direction of being pressed to permit downward insertion of the conductor.

To ensure parallel uniform insertion of conductors, it is preferable that the holding base parts of the insulating housing should be provided at adequate intervals thereamong in the lengthwise direction of the connecting parts of the contacts.

To reduce an insertion resistance of the conductor between the connecting part and the holding base part, it is preferable that the connecting part of each contact should have a horizontally curved inlet portion formed at an upper portion where an associated one of the conductors of the plurality of cables with different diameters are to be inserted, and a plurality of slits formed at the upper portion and open upward in the lengthwise direction of the connecting part at adequate intervals.

According to the cable connecting connector of the invention, when the heat chip of the heating apparatus for connection heats and presses a conductor, the conductor is pushed between the connecting part of the contact and the holding base part, thus laterally moving the connecting part and melting the holding base part. This reduces the pressure applied by the heat chip, thus reducing the load on the connector body. Because the holding base part is directly heated and melted by the associated conductor heated by the heat chip, the heat transfer distance becomes shorter, thereby ensuring efficient melting of the holding base part and shortening the time for soldered connection.

The contact has the crank part formed at the joint portion of the base part and the connecting part and bent laterally toward the holding base part, thus ensuring soldering with the connection with the conductor kept over approximately the entire length of the connecting part. This improves the reliability of soldering to achieve reliable electric connection.

The holding base parts of the insulating housing are provided at adequate intervals thereamong in the lengthwise direction of the connecting parts of the contacts, so that the resistance at the time of inserting the conductor between the connecting part and the holding base part does not become a large load, thus reducing the pressure applied by the heat chip, thus reducing the load on the connector body.

The upper portion of the connecting part of the contact where the associated conductor is to be inserted serves as a horizontally curved inlet portion formed, and a plurality of slits open upward in the lengthwise direction of the connecting part at adequate intervals are formed at the upper portion. This reduces the resistance of insertion between the connecting part of the conductor and the holding base part and the slits remarkably increase the soldering area to increase the force of holding the connecting part and the conductor. As apparent from the above, the heat chip can allow conductors of a plurality of cables with different diameters to reliably and collectively connected by soldering with a light load.

DETAILED DESCRIPTION OF THE PREFERRED EMBODIMENTS

Figure 1:
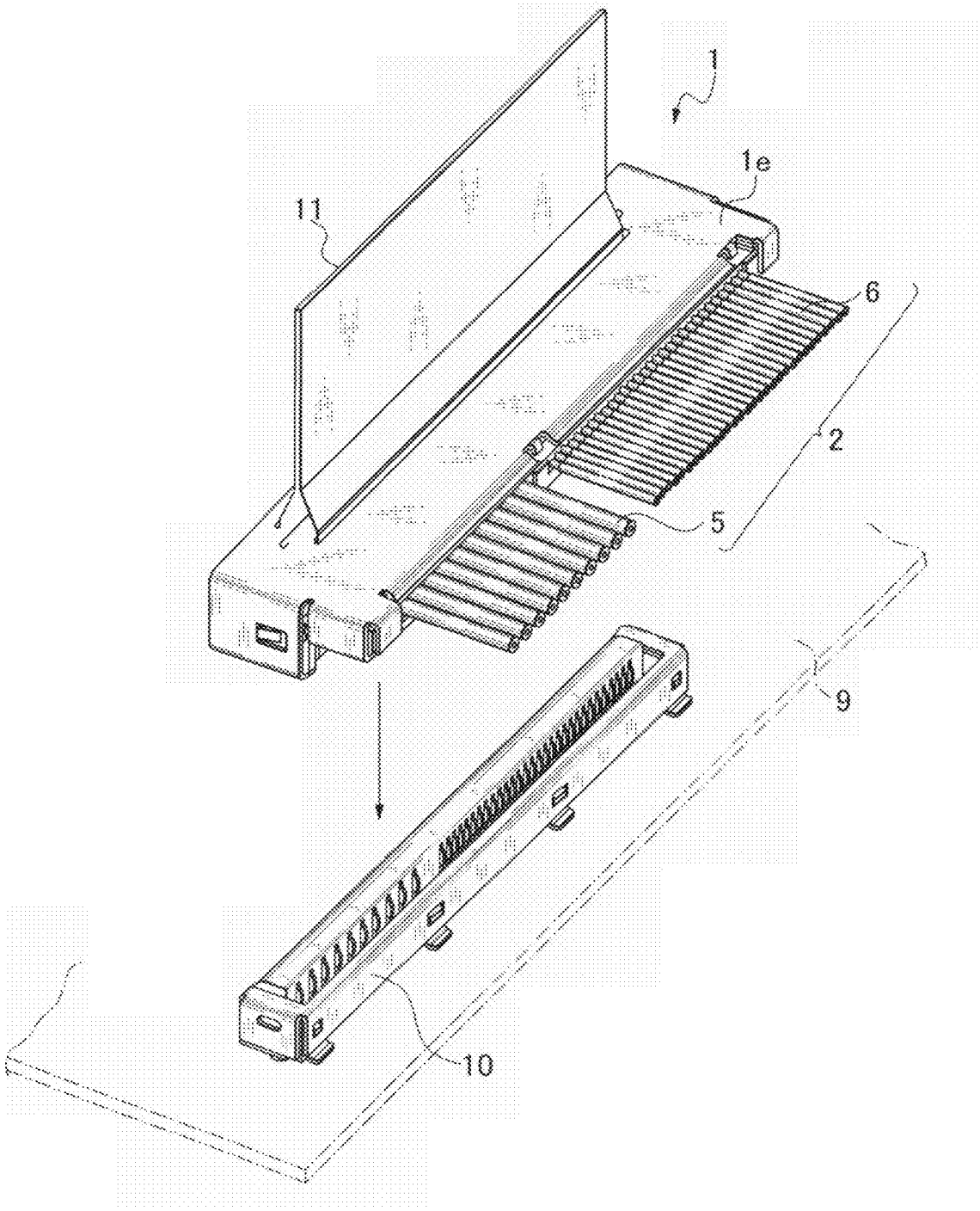
FIG. 1 is a perspective view showing a cable connecting connector according to an embodiment of the invention in use.

As shown in FIGS. 1 to 3B, a cable connecting connector 1 according to the invention is configured to collectively connect conductors (5*a*, 5*b*, . . . , and 6*a*, 6*a*, . . . ) of a cable assembly 2 having discrete wires 5 including conductors with various different diameters and thin coaxial wires 6 to contacts 4 with a heat chip 3 which is a heating unit of a heating apparatus for connection. As shown in FIG. 1, the cable connecting connector 1 is to be fitted into a connector receptacle 10 mounted on the top surface of a printed board 9, and has a pull-tab 11 for attachment and detachment.

Figure 4A:
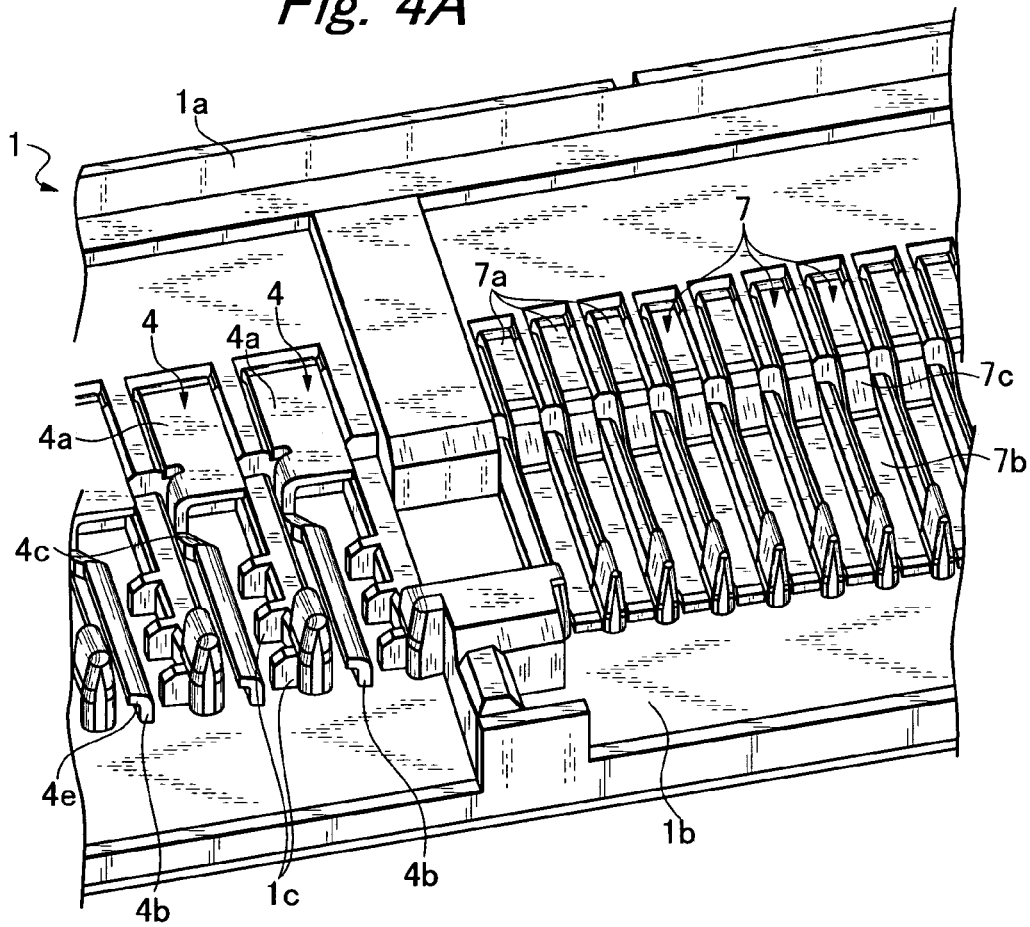
FIG. 4A is an enlarged perspective view showing a part of the cable connecting connector in enlargement.

As shown in FIGS. 1 and 4A, the cable connecting connector 1 includes a horizontally elongated insulating housing 1*a*, a plurality of contacts 4, 4, . . . to be connected to conductors 5*a*, 5*b*, 5*c*, . . . of the discrete wires 5 disposed in parallel in a direction approximately orthogonal to the lengthwise direction of the insulating housing 1*a*, contacts 7, 7, . . . to be connected to conductors 6*a*, 6*a*, . . . of a plurality of thin coaxial wires 6, and thermoplastic holding base parts 1*c* protruding from a flat surface 1*b* of the housing 1*a* into spaces between the contacts 4, 4.

The contact 4 has, as shown in FIG. 4A, a contact base 4*a* bent and securely press fitted to a fixation portion of the insulating housing 1*a*, and a connecting part 4*b* provided at the distal end of the contact base 4*a* and extending therefrom, with a crank part 4*c* being formed at the joint portion of the contact base 4*a* and the connecting part 4*b* and bent laterally toward the holding base parts 1*c*. The holding base parts 1*c* are provided at a plurality of locations, e.g., three in the embodiment, at intervals thereamong in the lengthwise direction a of the connecting part 4*b* of the contact.

Figure 4B:
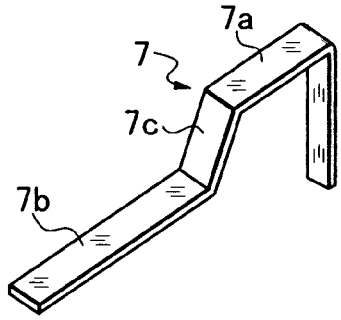
FIG. 4B is a perspective view showing a contact in the cable connecting connector to which the conductor of a thin coaxial wire is to be connected.

The contact 7 to which the conductor 6*a* of the thin coaxial wire 6 is to be connected has, as shown in FIG. 4B, a contact base 7*a* bent and securely press fitted to a fixation portion of the insulating housing 1*a*, and a connecting part 7*b* provided at the distal end of the contact base 7*a* and extending therefrom, with a crank part 7*c* being formed at the joint portion of the contact base 7*a* and the connecting part 7*b* and bent in the up and down direction.

Figure 5A:
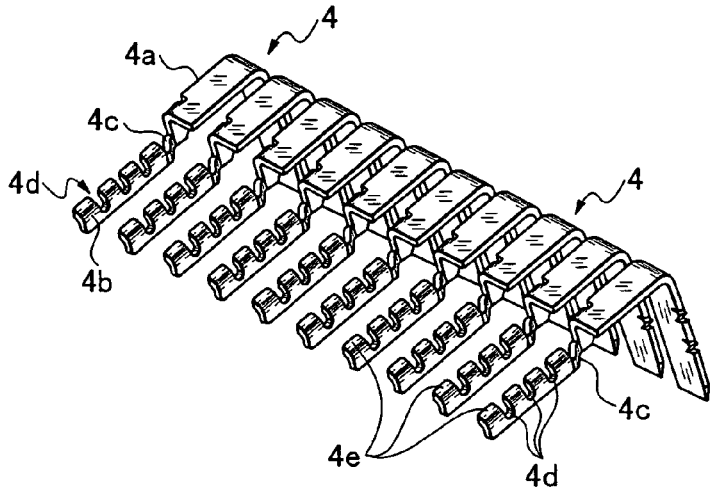
FIG. 5A is a perspective view showing contacts in a cable connecting connector according to another embodiment.
Figure 5B:
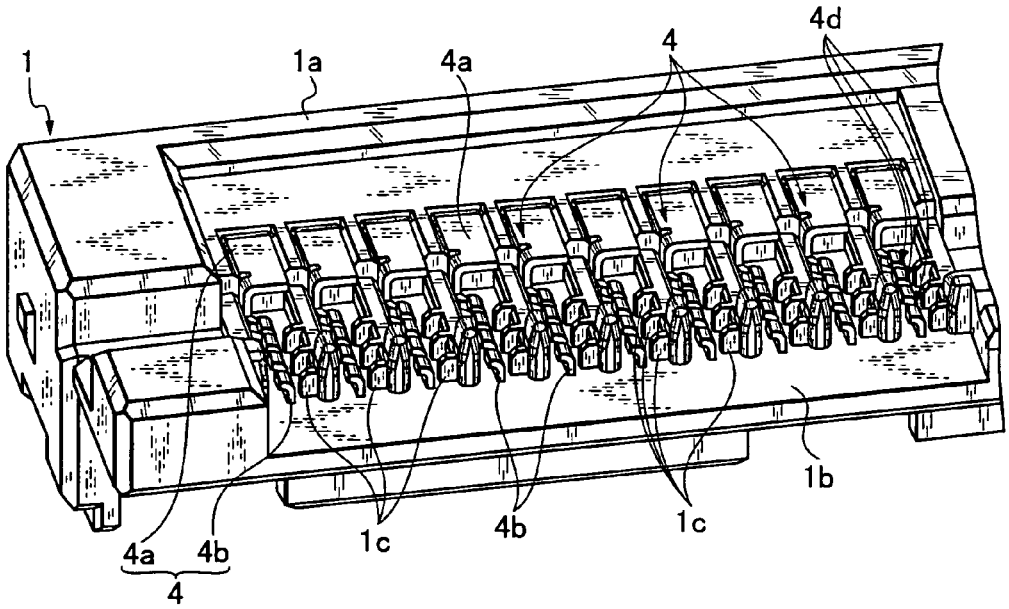
FIG. 5B is a partly omitted perspective view showing the cable connecting connector using the contact according to the another embodiment.

FIG. 5A shows contacts 4 according to another embodiment. The contact 4 has slits 4*d* formed at the upper portion of the connecting part 4*b* at adequate intervals in the lengthwise direction thereof. The provision of the slits 4*d* increases the area for soldering to the conductors 5*a*, 5*b*, . . . , thus making the connection firmer. FIG. 5B shows the cable connecting connector 1 using the contacts 4.

Figure 6:
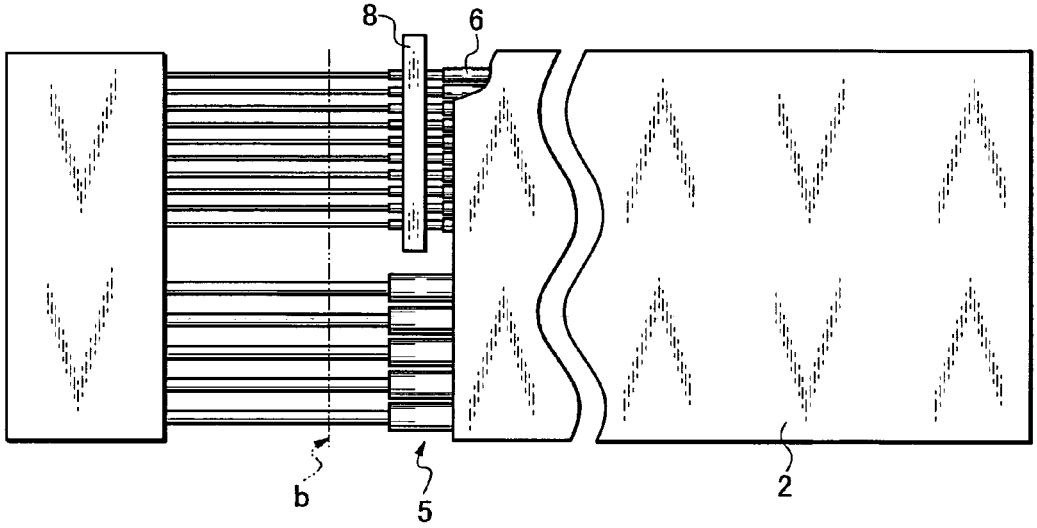
FIG. 6 is a plan view showing the temporarily soldered state of a cable assembly to be connected to the cable connecting connector.
Figure 7B:
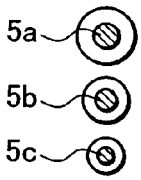
FIGS. 7A and 7B are respectively a plan view and a side view showing parts of discrete wires with different diameters in the cable assembly.
Figure 7A:
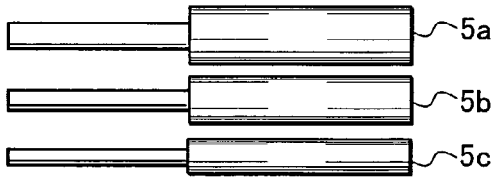
Figure 7D:
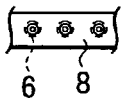
FIGS. 7C and 7D are respectively a plan view and a side view showing parts of thin coaxial wires in the cable assembly.
Figure 7C:
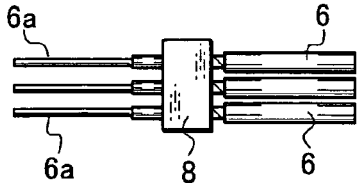

At the time of coupling the cable assembly 2 to the cable connecting connector 1 with the foregoing configuration, the distal ends of the conductors 5*a*, 5*b*, 5*c*, . . . , 6*a*, 6*a*, . . . temporarily soldered to a metal plate beforehand as needed, and excess lengths are cut off at a cut line "b", as shown in FIG. 6. The discrete wires 5 include conductors 5*a*, 5*b*, 5*c*, . . . with different diameters (e.g., ϕ0.38, ϕ0.3, ϕ0.24: unit of mm), as shown in FIGS. 7A and 7B. The thin coaxial wires 6 include conductors 6*a*, 6*a*, . . . with one diameter (e.g., ϕ0.15 mm), as shown in FIGS. 7C and 7D. A ground bar 8 is provided for electric shielding.

Figure 2A:
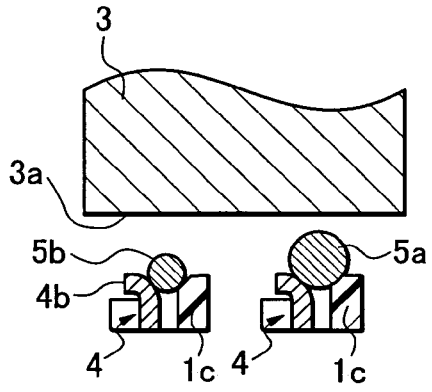
FIG. 2A is a longitudinal cross-sectional view showing partly the layout of a plurality of cables with different diameters in the cable connecting connector.
Figure 2B:
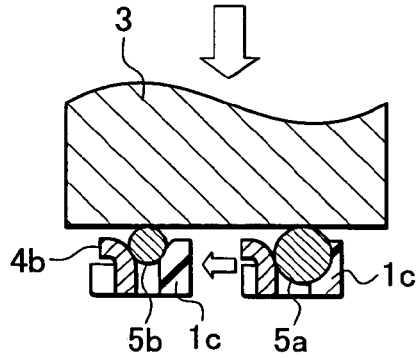
FIG. 2B is a longitudinal cross-sectional view showing partly a plurality of conductors collectively connected to the cable connecting connector.
Figure 3A:
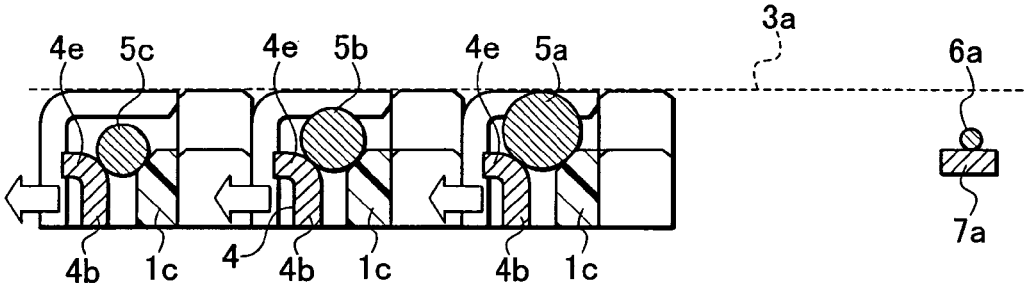
FIG. 3A is a longitudinal cross-sectional view showing partly the layout of the cables before collective connection of conductors of a plurality of discrete wires with different diameters and conductors of thin coaxial wires to the cable connecting connector.

The conductors 5*a*, 5*b*, 5*c*, . . . , 6*a*, 6*a*, . . . of the cable assembly 2 prepared in the above-described manner are mounted on the insulating housing 1*a* of the cable connecting connector 1, bringing about a state shown in FIGS. 2A and 3A. Next, the conductors 5*a*, 5*b*, 5*c*, . . . , 6*a*, 6*a*, . . . are collectively soldered to the contacts 4, 4, . . . with the heat chip 3 of the heating apparatus for connection.

In the soldering process, as shown in FIG. 3A, a bottom side 3*a* of the heat chip 3 abuts on the conductor 5*a* with the largest diameter first. As the conductor 5*a* is heated by the heat chip 3, the heat melts the holding base parts 1*c* of a synthetic resin at the three locations.

Further, the conductor 5*a* of the discrete wire 5 is consecutively pressed with the heat chip 3 and pushes the connecting part 4*b* of the contact 4 sideways while being soldered thereto, thus melting the holding base part 1*c* so that the conductor 5*a* is pushed down. At this time, the conductor 5*a* is smoothly guided to a curved inlet portion 4*e* in which the upper part of the connecting part 4*b* of the contact 4 is sideways bent and pushed therein, so that the resistance to the downward pressing is low. The crank part 4*c* allows the connecting part 4*b* of the contact 4 to be easily moved laterally with a lower resistance while abutting on the conductor 5*a* approximately in parallel thereto. Likewise, the crank part 7*c* allows the contact 7 to be moved downward while keeping the approximately parallel state to the connecting part 7*b* in the downward movement of the conductor 6*a*.

Figure 3B:
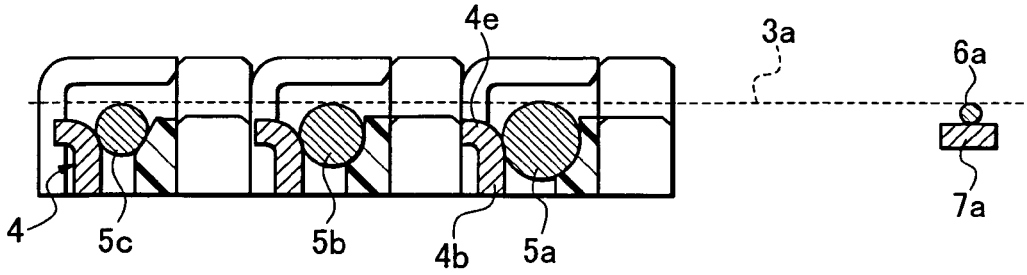
FIG. 3B is a longitudinal cross-sectional view showing partly the conductors collectively connected to the cable connecting connector.

The collective soldering work is completed when the bottom side 3*a* of the heat chip 3 moves further downward to abut on the conductor 5*b* and the conductor 5*c* in order after abutment to the conductor 5*a* with the largest diameter, until it abuts on the conductor 6*a* of the thin coaxial wire 6 with the smallest diameter and is soldered thereto, as shown in FIGS. 3A and 3B.

Figure 8:
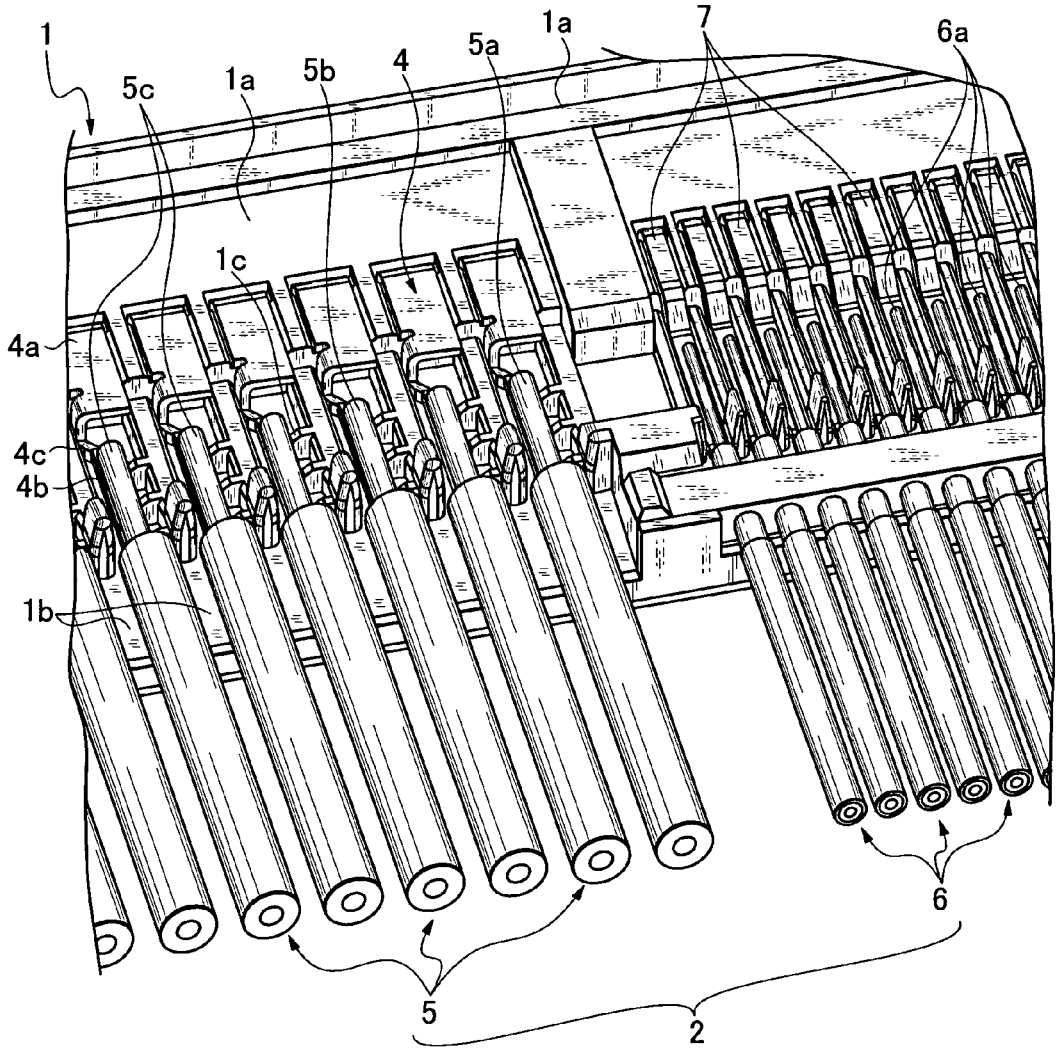
FIG. 8 is a perspective view showing part of the cable assembly soldered to the cable connecting connector.
Figure 9A:
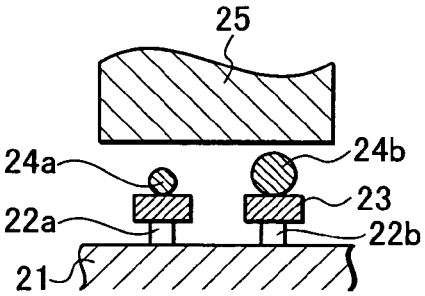
Fig. 9A PRIOR ART
FIGS. 9A and 9B are longitudinal cross-sectional views showing a conventional method of collectively connecting cables with different diameters.
Figure 9B:
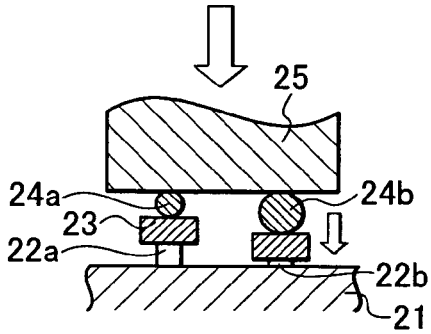
Fig. 9B PRIOR ART
Figure 10A:
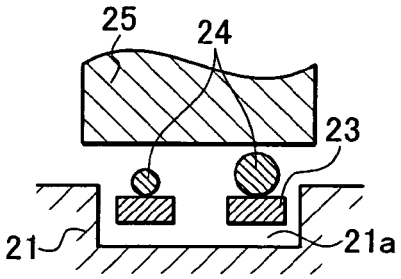
Fig. 10A PRIOR ART
FIGS. 10A and 10B are longitudinal cross-sectional views showing an another conventional method of collectively connecting cables with different diameters.
Figure 10B:
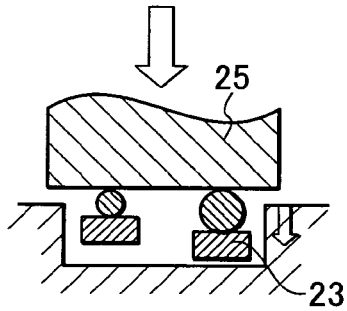
Fig. 10B PRIOR ART
Figure 11:
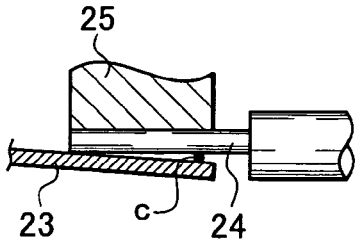
Fig. 11 PRIOR ART
FIG. 11 is a longitudinal cross-sectional view showing a conventional method of connecting thin coaxial wires.

In this manner, as shown in FIG. 8, the connecting parts 4*b* of the contacts 4 and the conductors 5*a*, 5*b*, 5*c*, . . . of the discrete wires 5 are soldered and firmly connected together over the entire contact portions where the connecting parts 4*b* were in contact with the conductors 5*a*, 5*b*, 5*c*, . . . at first. Also, the conductor 6*a* of the thin coaxial wire 6 are soldered and firmly connected over the entire contact portions with the connecting part 7*b* by keeping in parallel with a spring property of a crank part 7*c* of the contact 7.

Due to the requirement of the electric shield characteristic (measure against EMI (Electromagnetic Interference)), a metal case 1*e* is placed entirely over the insulating housing 1*a* as shown in FIG. 1.

The connecting parts 4*b* are pushed laterally according to the diameters of the conductors 5*a*, 5*b*, 5*c*, . . . which are inserted from above in such a way that the conductors are held by the connecting parts 4*b* of the contacts 4 in the cable connecting connector and the holding base parts 1*c* facing and apart from the connecting parts 4*b*, and the holding base parts 1*c* are melted by the heat from the heated conductors 5*a*, 5*b*, 5*c*, . . . , thereby permitting insertion of the conductors 5*a*, 5*b*, 5*c*, . . . and ensuring collective connection of the conductors 5 with different diameters.

In case of using the contact 4 having the slits 4*d* formed at the connecting part 4*b*, as shown in FIGS. 5A and 5B, the surface area of the connecting part 4*b* increases in the process of soldering the connecting part 4*b* to the conductor 5*a*, 5*b*, . . . , so that the soldering area remarkably increases, thus enhancing the connection strength.

What is claimed is:

1. A cable connecting connector for collectively connecting conductors of a plurality of cables with different diameters by a heat unit of a heating apparatus for connection, the connector comprising:

a horizontally elongated insulating housing;

a plurality of contacts each having a base part to be secured to the insulating housing, and a connecting part having a same height in an up and down direction, and arranged in parallel to one another and perpendicular to a lengthwise direction of the insulating housing; and thermoplastic holding base parts protruding from a flat surface of the insulating housing into spaces between the contacts and facing the connecting parts thereof, wherein the connecting part of each contact is moved laterally according to the diameter of the associated conductor when the associated conductor is inserted between the connecting part and the holding base part facing and apart from the connecting part from above, and the holding base part is melted by heat of the conductor heated to permit downward insertion thereof, thus ensuring collective connection of the plurality of conductors with different diameters.

2. The cable connecting connector according to claim 1, wherein the contact has a crank part formed at a joint portion of the base part and the connecting part and bent laterally toward the holding base part, so that the contact is bendable in a direction of being pressed to permit downward insertion of the conductor.

3. The cable connecting connector according to claim 1, wherein the plurality of holding base parts of the insulating housing are provided at adequate intervals thereamong in the lengthwise direction of the connecting parts of the contacts.

4. The cable connecting connector according to claim 2, wherein the plurality of holding base parts of the insulating housing are provided at adequate intervals thereamong in the lengthwise direction of the connecting parts of the contacts.

5. The cable connecting connector according to claim 1, wherein the connecting part of each contact has a horizontally curved inlet portion formed at an upper portion where an associated one of the conductors of the plurality of cables with different diameters are to be inserted, and a plurality of slits formed at the upper portion and open upward in the lengthwise direction of the connecting part at adequate intervals.

6. The cable connecting connector according to claim 2, wherein the connecting part of each contact has a horizontally curved inlet portion formed at an upper portion where an associated one of the conductors of the plurality of cables with different diameters are to be inserted, and a plurality of slits formed at the upper portion and open upward in the lengthwise direction of the connecting part at adequate intervals.

7. The cable connecting connector according to claim 3, wherein the connecting part of each contact has a horizontally curved inlet portion formed at an upper portion where an associated one of the conductors of the plurality of cables with different diameters are to be inserted, and a plurality of slits formed at the upper portion and open upward in the lengthwise direction of the connecting part at adequate intervals.

* * * * *